US005358569A

United States Patent [19]

Conroy et al.

[11] Patent Number: 5,358,569

[45] Date of Patent: Oct. 25, 1994

[54] CURTAIN COATING METHOD AND APPARATUS

[75] Inventors: James E. Conroy, Hamlin; Kenneth J. Ruschak, Rochester, both of N.Y.

[73] Assignee: Eastman Kodak Company, Rochester, N.Y.

[21] Appl. No.: 993,479

[22] Filed: Dec. 18, 1992

[51] Int. Cl.[5] ..... B05B 13/02; B05C 5/00

[52] U.S. Cl. ..... 118/324; 118/300; 118/325; 118/DIG. 4

[58] Field of Search ..... 118/324, DIG. 4, 325, 118/300

[56] References Cited

U.S. PATENT DOCUMENTS

| | | | |
|---|---|---|---|
| 4,075,976 | 2/1978 | Clayton | 118/324 |
| 4,135,477 | 1/1979 | Ridley | 118/325 |
| 4,267,795 | 5/1981 | Reba | 118/302 |
| 4,479,987 | 10/1984 | Koepke et al. | 427/402 |
| 4,510,882 | 4/1985 | Prato | 118/300 |
| 4,830,887 | 5/1989 | Reiter | 118/DIG. 4 |
| 4,974,533 | 12/1990 | Isbizuka et al. | 118/411 |

OTHER PUBLICATIONS

H. Schlichting, *Boundary Layer Theory*, pp. 185–187, (1987).

M. G. Antoniades, R. Godwin, S. P. Lin, *Journal of Colloid and Interface Science*, vol. 77, No. 2, pp. 583–585, (Oct. 1980).

D. J. Triton, *Physical Fluid Dynamics*, p. 12, (1982).

*Perry's Chemical Engineers' Handbook Sixth Edition*, pp. 5–35, (1984).

*Primary Examiner*—David A. Simmons
*Assistant Examiner*—Paul M. Rivard
*Attorney, Agent, or Firm*—Carl F. Ruoff

[57] ABSTRACT

The present invention is a method and apparatus for use on a curtain coating apparatus. In a curtain coater, edge guides (12) guide the free falling curtain from the hopper lip to the substrate to be coated. Lubricating liquid (15) is introduced near the hopper lip from the top of the edge guide (12). The present invention is a method and apparatus for introducing lubricating liquid (15) as close to the hopper lip as possible while avoiding any turbulence in the flow of the lubricating liquid (15).

5 Claims, 3 Drawing Sheets

CURTAIN COATING METHOD AND APPARATUS

TECHNICAL FIELD OF THE INVENTION

The present invention relates to a method and apparatus for coating objects or moving supports advancing continuously through a coating station with a free-falling curtain of coating liquid. More particularly, the present invention relates to a curtain coating method and apparatus for the manufacture of photographic film and paper.

BACKGROUND OF THE INVENTION

In a coating apparatus of the curtain coating type, a moving support is coated by causing a free falling curtain of coating liquid, referred to hereafter as simply the curtain, to impinge on the moving support to form a layer thereon. An apparatus to perform this method is described in U.S. Pat. No. 3,508,947 to Hughes wherein a multilayer composite of a plurality of distinct layers is formed on a slide hopper and dropped therefrom to form a falling curtain.

In the curtain coating process, particularly as used to manufacture multi-layer photographic materials, the quality of the coating is largely determined by the properties of the liquid curtain. It is important to insure that a stable laminar flow of coating solution is formed by the slide hopper and that an equally stable laminar liquid curtain is formed from that coating solution. To prevent contraction of the edges of the falling curtain under the effect of surface tension it is known that the curtain must be guided at its edges by curtain edge guides.

It is well known in the curtain coating art that introduction of a lubricating liquid between the curtain and the edge guide will improve the operation of the curtain. These improvements include the ability to maintain the curtain at lower total flow rates with lubricating liquid than without, and the ability to maintain curtains of higher viscosity with a lubricating liquid than without. Typically, the lubricating liquid is simply water, however, an alternate liquid of low viscosity may be used for the same purpose.

The momentum of the solutions at the coating point is a critical variable in determining the size of the window of operability of the curtain coating process. If the momentum is low, the maximum coating speed attainable before the onset of air entrainment is reduced. Therefore, for an internal edging process (coating within the edges of a web), the lubricating liquid must be introduced as close to the hopper lip as possible to maximize the momentum of the solution near the edge of the curtain at the coating point. This is to minimize the span the curtain must travel with a non-lubricated wall at the edge. Any velocity which is lost due to wall drag at the edges, with respect to the velocity of the curtain sufficiently far from the edge guides to be unaffected by the velocity drag of the edge guides, cannot be regained. Hence, at the coating point, the edges of the curtain will have lower momentum than will the middle due to wall drag along the edge guide. This results in a smaller window of operability at the edges of the curtain than in the middle. This limits the maximum speed attainable for the entire curtain. This coating speed reduction due to momentum loss at the edges can have a severe negative impact on the efficiency of a manufacturing operation employing curtain coating.

The prior art does not address a significant problem that can occur during the introduction of this lubricating liquid. This is turbulent flow from the outlet for the lubricating liquid at the top of the edge guide. If the flow is turbulent at this point the resulting edge will be wavy, meaning the coating width will randomly change due to the chaotic nature of the flow of the lubricating liquid. Edge waviness reduces the overall quality of the coating as well as increasing the potential for waste in manufacturing. Turbulent flow of the lubricating liquid can also produce waves in the curtain, which propagate from the edge into the main body of the curtain, and which can form streak imperfections in the coating where they meet the substrate.

In laminar flow, turbulent flow is initiated at disturbances and will decay to fully laminar flow according to empirical relationships. A sharp corner, a rough wall, an abrupt change in geometry and many other disturbances will initiate turbulent flow. Turbulent and laminar flow regimes are generally classified through use of the Reynolds number, Re. This is a dimensionless group of parameters used to relate the inertial forces in a flow to the viscous forces. At high Reynolds numbers turbulence is more likely than at low Reynolds numbers. For different flow geometries, experiments have determined Reynolds number ranges which classify the laminar flow, transition regions and fully turbulent flow region. It is therefore desirable to be operating in the laminar flow region for the specific geometry being used. However, in the laminar flow region disturbances may still initiate turbulence but these disturbances will then decay. The rate of decay is dependent upon the magnitude of the Reynolds number, the lower the Reynolds number, the quicker disturbances will decay. The rate of decay, or length that the flow must continue past the disturbance to be free of turbulence can be estimated by calculating the entry length, $L_e$. The entry length is a measure of how much distance the liquid must travel after a disturbance, for example, the inlet of a channel, to form a fully developed laminar flow profile. For tube flow (circular cross-section) this is the distance after the inlet into the tube it takes to develop Poiseuille flow.

The present invention describes an apparatus and method for optimizing the geometry of the lubricating fluid delivery tube or channel to allow for the outlet to be placed very close to the hopper lip, while avoiding turbulence at the outlet. This results in being able to coat at higher speeds due to an increase in momentum at the edges of the curtain and the elimination of wavy edges and curtain waves due to turbulent flow of the lubricating liquid.

SUMMARY OF THE INVENTION

The present invention concerns a method and apparatus for coating a support by depositing one or more coating liquids onto the moving support. The apparatus includes a conveying means including a coating roll for moving the support along a path through a coating zone, hopper means for forming one or more flowing layers of coating liquids to form a composite free-falling curtain which extends transversely of said path and impinges on the moving support, and edge guide means spaced a distance apart for laterally guiding the falling curtain. A liquid distributing means for issuing the lubricating liquid from the edge guide means is used to maintain wetting contact with the edge of the falling curtain, the liquid distributing means issues lubricating liquid in the laminar flow region.

In a preferred embodiment of the present invention, the liquid distributing means comprises a curved duct which has a circular cross-section and the lubricating liquid is water. The arc length of the duct in centimeters is greater than or equal to L wherein L is determined by the relationship:

$$L=11*Q$$

wherein Q is the flow rate of water in cc/sec through the duct.

In an alternate embodiment, the lubricating liquid is water and the liquid distribution means comprises a curved rectangular duct having an arc length in centimeters greater than or equal to L wherein L is determined by the relationship $$L=6*Q*D/(D+W)$$

wherein Q is the flow rate of water in cc/sec through the duct, D is the depth of the duct, in centimeters, measured transversely to the curtain and W is the width of the duct, in centimeters, measured parallel to the curtain.

In a preferred embodiment of the invention the liquid distribution means is a duct having a radius of curvature of approximately 0.6 cm to about 1.2 cm.

For a better understanding of the present invention, together with other advantages and capabilities thereof, reference is made to the following detailed description and appended claims in connection with the preceding drawings and description of some aspects of the invention.

DETAILED DESCRIPTION OF THE PREFERRED EMBODIMENT

Figure 1:
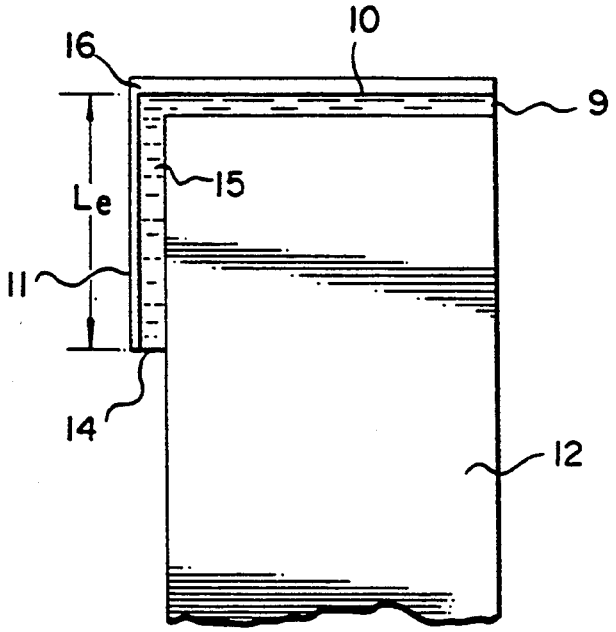
FIG. 1 PRIOR ART
FIG. 1 shows a prior art lubricating fluid delivery tube.

The present invention relates to optimizing the geometry of the lubricating liquid delivery tube or channel to allow for the outlet to be placed very close to the hopper lip while avoiding turbulence at the outlet of the delivery tube. The prior art shown in FIG. 1, uses a sharp 90° bend to turn the flow of the lubricating liquid vertically downward, i.e. parallel to the edge guide. FIG. 1 shows an edge guide 12 in which lubricating liquid 15 is introduced through conduits 10 and 11. The conduits are joined at a sharp corner 16. The sharp corner 16 introduces a disturbance into the flow. In order for this disturbance to decay sufficiently, conduit 11 must be sufficiently long to allow flow at the outlet 14 to be laminar.

Figure 2:
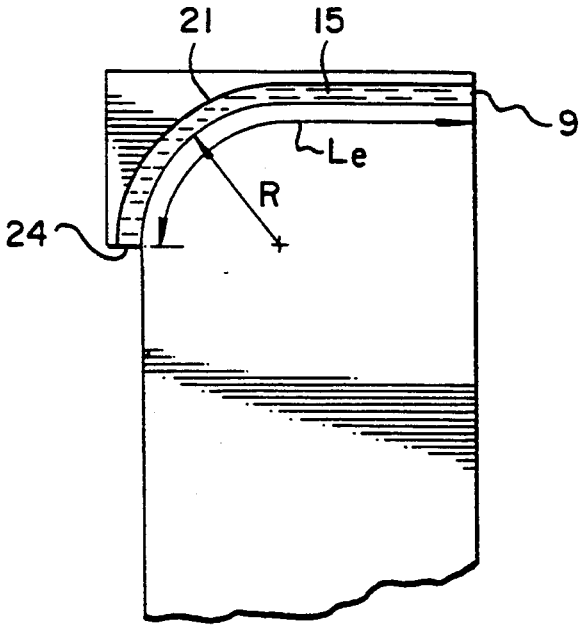
FIG. 2 shows the lubricating fluid delivery tube of the present invention.

FIG. 2 shows the lubricating liquid delivery tube of the present invention. The present invention introduces the lubricating liquid 15 through the delivery duct 21 to the outlet 24. The invention does not use the sharp 90° bend to turn the flow thus avoiding the turbulence the sharp bend creates. This allows the outlet to be closer to the hopper lip than in the prior art. The outlet is shown issuing lubricating liquid vertically downward to minimize disturbances as the curtain and lubrication layer merge but the outlet may issue fluid at any desired angle. The inlet length for the invention can be estimated by calculating the arc length of the curved path back to the inlet of the duct. The curve must be smooth but not necessarily circular. It is only necessary that the minimum radius of the curve, R, be sufficiently large. Thus, the present invention allows for the outlet of the lubricating water delivery tube to be much closer to the hopper lip while avoiding turbulence and associated manufacturing quality losses. Having the inlet closer to the hopper lip increases the momentum of the curtain near the edge allowing for higher coating speeds.

In order to design the lubricating liquid delivery tube, an estimate of the entry length $L_e$ as shown in FIGS. 1 and 2 must be made. This is the length of tube or duct of low curvature which must follow any point in the design at which turbulence is initiated. Referring to FIG. 1 two such points are illustrated. These are the inlet 9, where geometries may not match, and the sharp corner 16.

Figure 3:
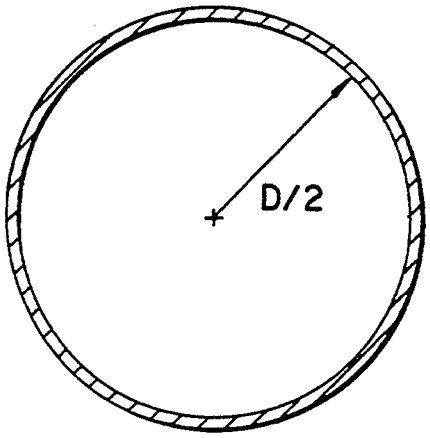
FIG. 3 shows the cross-section of a circular duct.
Figure 4:
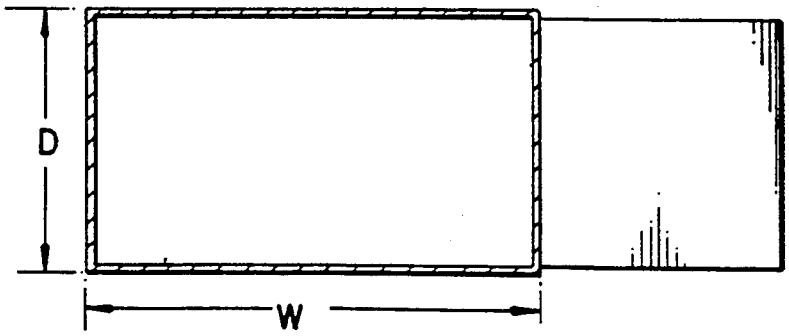
FIG. 4 shows the cross-section of a rectangular duct and a portion of the falling curtain.

The cross-section of duct which is used to deliver the lubricating liquid is chosen so as to provide a smooth transition for the curtain having its edge against the wall to having its edge against the lubricating liquid. This typically means that the depth of the outlet of the lubricating liquid is on the order of the curtain thickness at the point which they meet (on the order of 0.05 cm). Therefore, for a circular cross-section duct as shown in FIG. 3, the diameter would be on the order of 0.05 cm and for a rectangular channel as shown in FIG. 4 the depth of the channel D in the direction normal to the curtain plane would be on the order of 0.05 cm.

For a duct of circular cross-section (see FIG. 3) the inlet length is given by the following relationship: [See R. H. Perry, D. Green, *Perry's Chemical Engineer's Handbook,* 6th Ed., 1984, pp. 5–35].

$$L_e \approx 0.056(Re*D)$$

where:

$$Re \approx (\rho UD)\mu = (\rho QD)/(\mu A) = (4\rho Q)/(\pi \mu D)$$

where D is the diameter in cm of the tube used to deliver the lubricating liquid, U is the average velocity in cm/sec of the liquid in the fluid tube, Q is the total flow rate in cc/sec of the liquid, $\mu$ is the viscosity in gm/(cm-sec) of the liquid, and $\rho$ is the density in gm/cc of the liquid.

For a duct of rectangular cross-section (see FIG. 4) the inlet length is given by the following relationship: [R. H. Perry, D. Green, *Perry's Chemical Engineer's Handbook,* 6th Ed, 1984, pp 5–35].

$$L_e \approx 0.022\left(\frac{\rho Q}{\mu}\right)*\left(\frac{D}{(D+W)}\right)$$

where D is the depth of the channel in cm used to deliver the lubricating liquid, W is the width of the channel in cm used to deliver the lubricating liquid, Q is the total flow rate in cc/sec of the liquid, $\mu$ is the viscosity in gm/(cm-sec) of the liquid, and $\rho$ is the density in gm/cc of the liquid.

Therefore, the following relationships are used to determine the minimum inlet length for a lubricating liquid having a viscosity, $\mu$ in gm/cm-sec and a density, $\rho$ in gm/cc.

$$\text{Circular inlet: } L_e = 0.07\left(\frac{\rho Q}{\mu}\right)$$

wherein Q is the volumetric flowrate in [cc/sec] and D is the diameter of the tube.

$$\text{Rectangular inlet: } L_e = 0.04\left(\frac{\rho Q}{\mu}\right)*\left(\frac{D}{(D+W)}\right)$$

wherein Q is the volumetric flowrate in [cc/sec], D is the depth of the channel in cm and W is the width of the channel in cm and W is larger than 1. If W>>D then this relationship reduces to $$L_e = 0.04\left(\frac{\rho Q}{\mu}\right)*\left(\frac{D}{W}\right)$$

Using water as the lubricating liquid delivered at a temperature of 40° C. these relationships reduce to the following [cgs units]:

$$\text{Circular inlet: } L_e = 11*Q$$

$$\text{Rectangular inlet: } L_e = 6*Q*\left(\frac{D}{(D+W)}\right)$$

Figure 5:
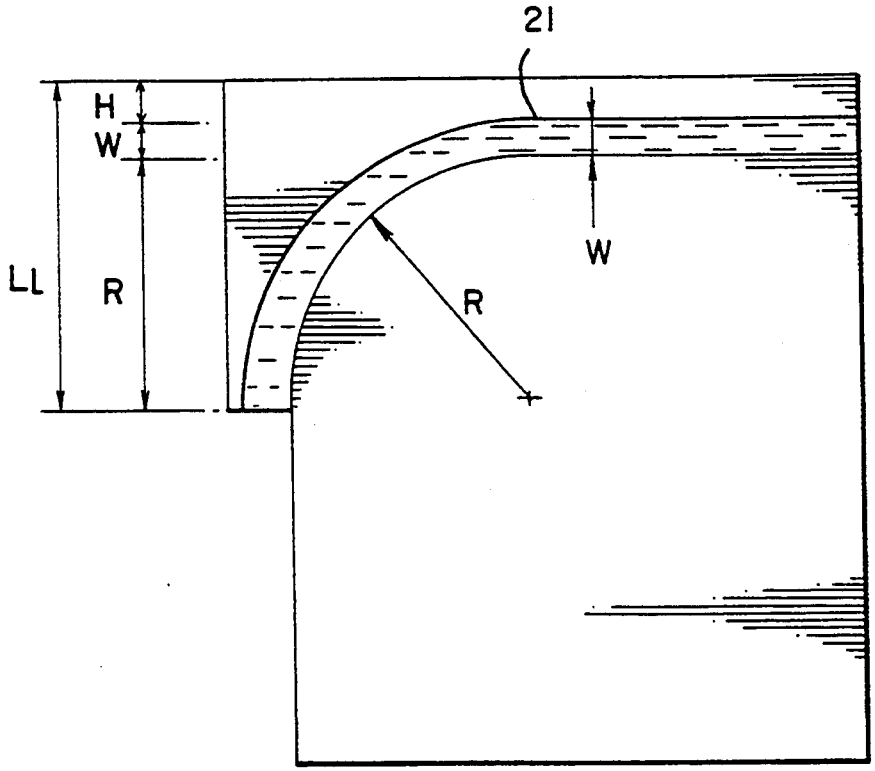
FIG. 5 shows the lubricating liquid delivery duct of the present invention.

After the inlet length has been calculated, it is then necessary to choose the radius of curvature to turn the flow in the downward direction. Experimentally, radii of 1.2 cm and 0.6 cm have been successful in delivering flow rates of up to 0.83 cc/sec without turbulence at the outlet. Once the radius has been chosen the design can be finalized and the distance from the hopper lip to the lubricating fluid outlet can be calculated. FIG. 5 shows a final design with the parameters needed to determine the distance from the hopper lip. As shown in FIG. 5, the delivery duct 21 has a radius R. The channel width W, or tube diameter D is also shown. The total length before the lubricating liquid is introduced, $L_L$, is the sum of the radius, R; channel width, W; and wall thickness, H. This is shown as R plus W plus H.

Figure 6:
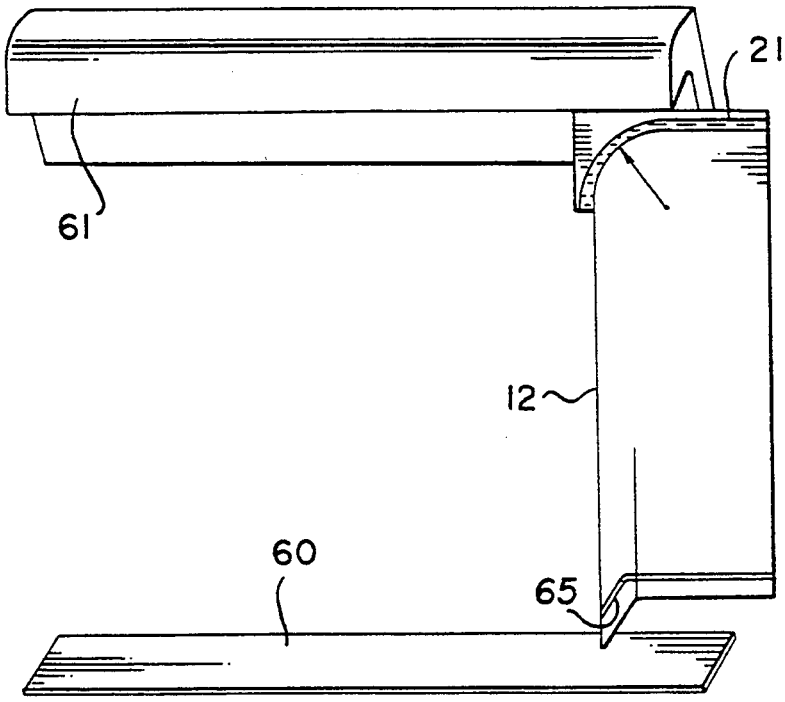
FIG. 6 shows the present invention and its relation to other standard pieces of the curtain coating process.

FIG. 6 shows a view of the lubricating liquid delivery tube 21 in its relative position with the hopper lip 61, edge guide 12, and substrate 60. The substrate is moved by conveying means such as a coating roll (not shown) through a free falling curtain. This is an overall view of how the invention fits with the curtain coating process. The lubricating liquid is delivered just after the hopper lip and flows down along the edge guide guiding the curtain to the substrate 60. The lubricating liquid is removed by liquid removing means 65, such as a slotted vacuum tube as shown in U.S. Pat. No. 4,830,887.

While there has been shown and described what are at present considered the preferred embodiments of the invention, it will be obvious to those skilled in the art that various changes, alterations and modifications may be made therein without departing from the scope of the invention as defined by the appended claims.

What is claimed is:

1. An apparatus for curtain coating a support by depositing one or more coating liquids onto a moving support comprising:

conveyor means including a coating roll for moving said support along a path through a coating zone;

hopper means for forming one or more flowing layers of coating liquids to form a composite free falling curtain which extends transversely of said path and impinges on said moving support;

edge guide means spaced a distance apart for laterally guiding said falling curtain;

liquid distributing means for issuing a lubricating liquid from said edge guide means to maintain wetting contact with said falling curtain, said liquid means issuing the lubricating liquid in essentially laminar flow said liquid distributing means comprising a duct having a circular cross-section and a length, the length in cm of the duct being equal to or greater than L wherein L is determined by the relationship:

$$L = 0.07\left[\frac{\rho Q}{\mu}\right]$$

Q is the flow rate through the duct in $cm^3$/sec.

$\rho$ is the density of the lubricating liquid in gm/cc, and $\mu$ is the viscosity of the lubricating liquid in gm/cm sec, wherein the duct is curved and has minimum radius of curvature of from about 0.6 cm. to about 1.2 cm.

2. The apparatus according to claim 1 further comprising:

liquid removal means for extracting liquid from the edge region of said falling curtain.

3. The apparatus according to claim 1 wherein said lubricating liquid is water at approximately 40° C. and L is determined by the relationship;

$$L=11*Q$$

wherein Q is the flow through the duct of said lubricating liquid in $cm^3$/sec.

4. An apparatus for curtain coating a support by depositing one or more coating liquids onto a moving support comprising:

conveyor means for forming one or more flowing layers of coating liquids to form a composite free falling curtain which extends transversely of a path and impinges on said moving support;

edge means spaced a distance apart for laterally guiding said falling curtain;

liquid distributing means for issuing a lubricating liquid from said edge guide means to maintain wetting contact with said falling curtain, said liquid means issuing the lubricating liquid in essentially laminar flow, said liquid distributing means comprising a duct having a rectangular cross section and a length, the length in cm of the duct being equal to or greater than L wherein L is determined by the relationship;

$$L = 0.04\left(\frac{\rho Q}{\mu}\right)*\left(\frac{D}{(D+W)}\right)$$

wherein:

Q is flowrate through the duct in $cm^3/sec$

D is the depth of duct in cm measured transverse to the curtain

W is the width of the duct in cm measured parallel to the curtain $\rho$ is density of the lubricating liquid in gm/cc, and $\mu$ is the viscosity of the lubricating liquid in gm/(cm-sec) wherein the duct is curved and has a minimum radius of curvature of from about 0.6 cm. to about 1.2 cm.

5. The apparatus according to claim 4 wherein said lubricating liquid is water at approximately 40° C. and L is determined by the relationship;

$$L=6*Q*D/(D+W)$$

wherein:

Q is the flowrate through the duct in $cm^3/sec$;

D is the depth of the duct in cm measured transverse to the curtain;

W is the width of the duct in cm measured parallel to the curtain.

* * * * *